US007893400B2

(12) United States Patent
Togashi

(10) Patent No.: US 7,893,400 B2
(45) Date of Patent: Feb. 22, 2011

(54) METHOD FOR LASER DESORPTION/IONIZATION MASS SPECTROMETRY, SAMPLE SUPPORTING SUBSTRATE USED THEREIN, AND SUBSTRATE MATERIAL TESTING METHOD

(75) Inventor: Hisashi Togashi, Tsukuba (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 309 days.

(21) Appl. No.: 12/112,074

(22) Filed: Apr. 30, 2008

(65) Prior Publication Data

US 2008/0290271 A1 Nov. 27, 2008

(30) Foreign Application Priority Data

May 1, 2007 (JP) ..... 2007-120917

(51) Int. Cl.
*H01J 49/10* (2006.01)
*H01J 49/26* (2006.01)

(52) U.S. Cl. ..... 250/288; 250/281; 250/282

(58) Field of Classification Search ..... 250/281, 250/282, 288

See application file for complete search history.

(56) References Cited

U.S. PATENT DOCUMENTS 6,610,976 B2 8/2003 Chait et al.
6,900,061 B2 5/2005 Smirnov et al.
7,053,366 B2 5/2006 Bouvier et al.
2003/0008404 A1 * 1/2003 Tomita et al. ..... 436/72
2007/0057173 A1 * 3/2007 Kovtoun ..... 250/281
2008/0067346 A1 * 3/2008 Amster et al. ..... 250/282

FOREIGN PATENT DOCUMENTS

JP 05-062643 3/1993
JP 2001-057174 2/2001
JP 2004-158005 6/2004
JP 2006-201042 8/2006
JP 2006-329977 12/2006

* cited by examiner

*Primary Examiner*—Robert Kim
*Assistant Examiner*—Nicole Ippolito Rausch
(74) *Attorney, Agent, or Firm*—Ladas & Parry LLP

(57) ABSTRACT

There is disclosed a method of performing laser desorption/ionization mass spectrometry based on ions generated by exposing a sample supported on a substrate to laser light, the sample being to be subjected to spectrum analysis. The method includes the steps of (a) causing a part of the ions to be generated through one of an interaction between the laser light and a surface of the substrate and an interaction between the laser light and an interface between the substrate and the sample; and (b) determining the generated part of the ions to be index ions and identifying a signal to become noise in the laser desorption/ionization mass spectrometry using a signal of the index ions, thereby performing the spectrum analysis without an effect of the noise.

15 Claims, 8 Drawing Sheets

METHOD FOR LASER DESORPTION/IONIZATION MASS SPECTROMETRY, SAMPLE SUPPORTING SUBSTRATE USED THEREIN, AND SUBSTRATE MATERIAL TESTING METHOD

BACKGROUND OF THE INVENTION

1. Field of the Invention

The present invention relates to a laser desorption/ionization mass spectrometry method, a sample supporting substrate used in laser desorption/ionization mass spectrometry, and a method of testing a material for the sample supporting substrate.

2. Description of the Related Art

Mass spectrometry using a laser for ionization is used for, for example, measuring the molecular weight or atomic weight of a sample or analyzing its molecular structure or components in such fields as the chemical industry, clinical medicine, and biotechnology. Mass spectrometry includes LDI-MS (Laser Desorption/Ionization Mass Spectrometry), which includes MALDI-MS (Matrix-Assisted Laser Desorption/Ionization Mass Spectrometry).

According to MALDI-MS, ions are generated by exposing a sample solution dropped on a sample plate to laser light after evaporating its solvent. The generated ions are spatially or temporally separated in accordance with their mass-to-charge ratios (m/z) in an electric field or magnetic field, and electrical signals reflecting their amounts are measured.

MALDI-MS is regarded as excellent as a highly sensitive spectrometry technique but as limited in usefulness because of difficulty in ensuring data reproducibility due to frequent variations in the amount of ions generated at each laser pulse.

This is partly because a sample on the substrate tends to have a small thickness in order to keep the electric field uniform where ions are generated and the substrate surface often contains minute unevenness in order to have the sample evenly adhere to the substrate surface. Therefore, laser light often reaches the substrate surface through the sample to cause ions to be generated from the interface between the substrate and the sample, so as to cause a mixture of the generated ions with ions from the sample.

It is believed that the amount of ions observed greatly varies because of the mixture of ions generated from two different environments and variations in the mixture ratio due to the thickness distribution of the sample and the evaporation of the sample by exposure to laser light. As a result, there is an increase in undesirable ions other than those derived from the sample, that is, background noise.

Known techniques for reducing background noise are as follows.

(a) Japanese Laid-Open Patent Application No. 5-062643 shows a time-of-flight mass spectrometer having an electrostatic shutter and a time-of-flight mass spectrometry method using the same, where undesirable ions are removed by spatially and temporally selecting those to be introduced into an analyzer from generated ions. Further, Japanese Laid-Open Patent Application No. 2001-057174 shows a magnetic sector mass spectrometer that removes undesirable ions in the same manner.

(b) Japanese Laid-Open Patent Application No. 2004-158005 shows a method of creating a database and a database for identifying a polymorphic genetic marker, where signals of undesirable ions, that is, noise, is removed by performing mathematical processing on a measured spectrum.

(c) Japanese Laid-Open Patent Applications No. 2006-201042 and No. 2006-329977 each show an ionization substrate for laser desorption/ionization mass spectrometry and a laser desorption/ionization mass spectrometer, where a material that is less likely to cause generation of undesirable ions is used for the substrate.

However, such a method that selects ions to be introduced into the analyzer as shown above in (a) is less effective in removing the noise of background ions spatially or temporally close to necessary ions.

Further, such a method that performs mathematical processing on an already measured spectrum as shown above in (b) is limited in removing background noise because the method cannot help being applied to a spectrum that has already contained noise since no consideration is given to whether laser light has reached the substrate.

Further, such a method that reduces the amount of ions to be generated from a substrate material as shown above in (c) has the difficulty of not being able to give consideration to whether laser light has reached the substrate because once the laser light reaches the substrate, background ions may be generated from a sample at the interface between the sample and the substrate, thus making it impossible to observe ions derived from the substrate material.

SUMMARY OF THE INVENTION

Embodiments of the present invention may solve or reduce one or more of the above-described problems.

According to one or more embodiments of the present invention, there are provided a laser desorption/ionization mass spectrometry method and a sample supporting substrate used in laser desorption/ionization mass spectrometry in which one or more of the above-described problems may be solved or reduced. Further, there is also provided a method of testing a material for the sample supporting substrate.

According to one embodiment of the present invention, there are provided a laser desorption/ionization mass spectrometry method and a sample supporting substrate used in laser desorption/ionization mass spectrometry according to which a desirable signal is extracted and/or undesirable background noise is removed using a signal of ions (index ions) generated by the interaction between pulsed laser light and the surface of the substrate or the interface between a sample and the substrate. The desirable signal may be extracted and/or undesirable background noise may be removed by performing operations including classification and an operation on spectra at respective pulses.

According to one embodiment of the present invention, there is provided a method of performing laser desorption/ionization mass spectrometry based on ions generated by exposing a sample supported on a substrate to laser light, the sample being to be subjected to a spectrum analysis, the method including the steps of (a) causing a part of the ions to be generated through one of an interaction between the laser light and a surface of the substrate and an interaction between the laser light and an interface between the substrate and the sample; and (b) determining the generated part of the ions as index ions and identifying a signal to become noise in the laser desorption/ionization mass spectrometry using a signal of the index ions, thereby performing the spectrum analysis without an effect of the noise.

According one embodiment of the present invention, there is provided a substrate for supporting a sample to be subjected to a spectrum analysis in a laser desorption/ionization mass spectrometer performing laser desorption/ionization mass spectrometry based on ions generated by exposing the sample supported on the substrate to laser light, the substrate including a material from which ions are easily generable in response to the exposure to the laser light, the material being provided at least a surface of the substrate, so that the ions generated from the material are determined to be index ions and a signal to become noise in the laser desorption/ionization mass spectrometry is determined using a signal of the index ions, thereby performing the spectrum analysis without an effect of the noise.

According to a laser desorption/ionization mass spectrometry method and a sample supporting substrate used in laser desorption/ionization mass spectrometry of the present invention, it is possible to automatically or manually extract a desirable peak and/or remove undesirable background noise by determining index ions and the reference value of the signal of the index ions. Further, the amount of information to be obtained increases because of improvement in spectrum quality, so that the efficiency of analysis is improved.

Further, according to one embodiment of the present invention, there is provided a method of testing a material for a substrate for supporting a sample in a laser desorption/ionization mass spectrometry, the method including the steps of: preparing a test substrate of the material; applying a solution containing a plurality of different salts as solutes evenly on the test substrate, and drying the test substrate; exposing the test substrate to laser light with varying intensity; observing generation of ions from the test substrate; and determining that the material is to be used for the substrate for supporting the sample in the laser desorption/ionization mass spectrometry if the ions of the material are observed whenever univalent positive ions of the solution are observed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention.

Figure 1:
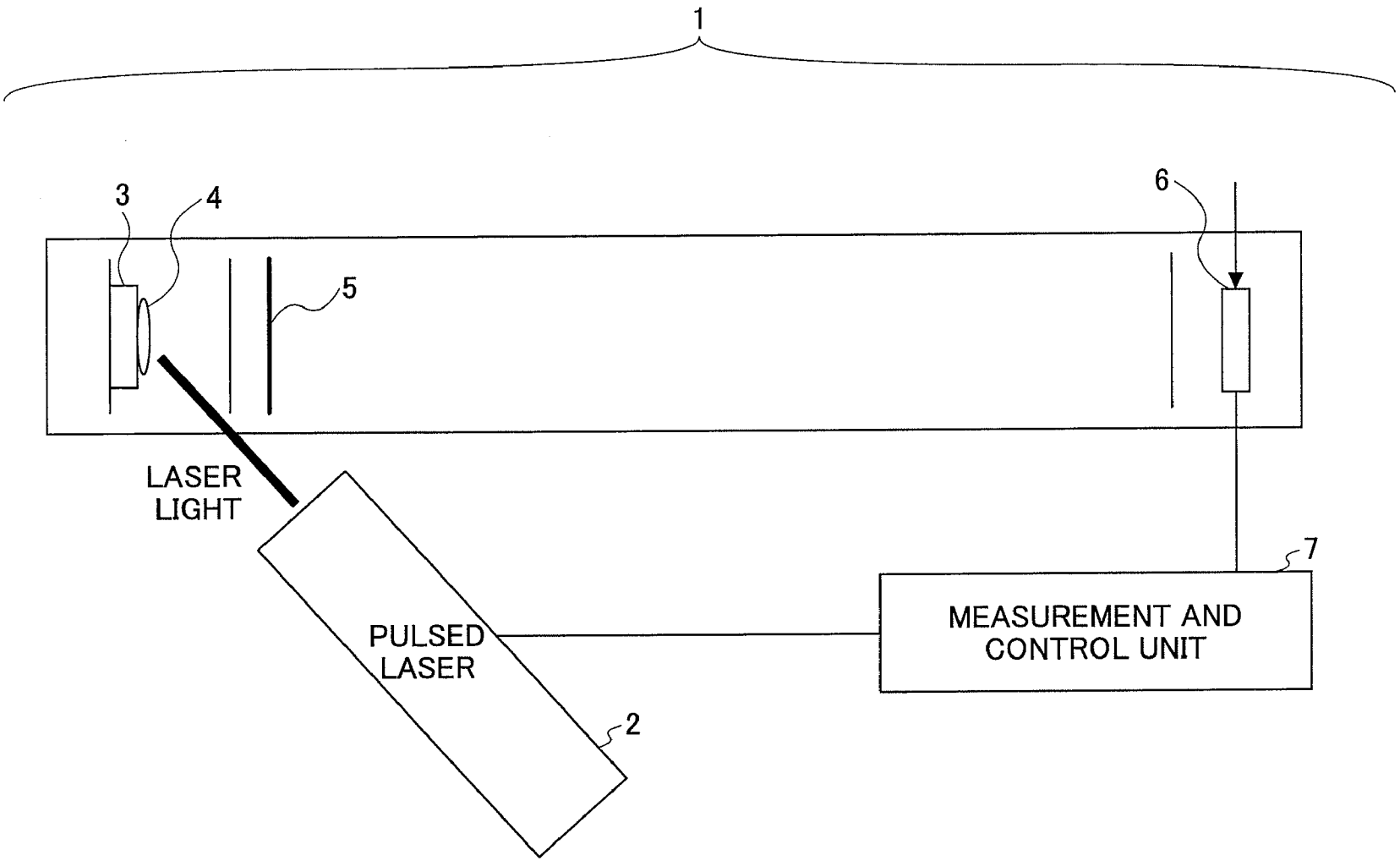
FIG. 1 is a schematic diagram showing a laser desorption/ionization mass spectrometer that implements a laser desorption/ionization mass spectrometry method according to an embodiment of the present invention.

FIG. 1 is a schematic diagram showing a laser desorption/ionization mass spectrometer 1 that implements a laser desorption/ionization mass spectrometry method according to the embodiment of the present invention.

Referring to FIG. 1, the laser desorption/ionization mass spectrometer 1 includes a pulsed laser 2, an ion accelerating electrode 5, an ion detector 6, and a measurement and control unit 7. The pulsed laser 2 may be, for example, a gaseous nitrogen laser or a YAG laser. Laser light is emitted from the pulsed laser 2 onto a sample 4 placed on the surface of a substrate 3 so as to cause generation of ions. After being suitably accelerated by the ion accelerating electrode 5, the generated ions are temporally separated in accordance with their mass-to-charge ratios while flying in a space with hardly any electric field, so as to reach the ion detector 6. Then, the ions are converted into current values corresponding to their detected ion intensities (the amounts or numbers of ions generated) in the measurement and control unit 7.

According to a laser desorption/ionization mass spectrometry method using this laser desorption/ionization mass spectrometer 1, the sample 4 supported on the substrate 3 is exposed to pulsed laser light, and the intensities of ions generated from the sample by the exposure are measured as current values, thereby obtaining a spectrum showing a current distribution with respect to m/z (mass-to-charge ratio). The sample 4 is structurally analyzed based on peaks in this spectrum. Usually, the same substrate 3 and sample 4 are exposed to multiple laser pulses, and all the spectra obtained at the respective pulses are integrated or averaged to form a spectrum to be analyzed.

Depending on the shape (thickness, unevenness, etc.) of the sample 4, the laser light transmitted through the sample 4 may reach the surface of the substrate 3, more technically, the interface between the sample 4 and the substrate 3, so as to cause ions to be generated from the substrate 3. These ions generated from the substrate 3 become noise when measured with the ions of the sample 4.

Conventionally, a material that produces as few ions as possible in response to exposure to laser light, such as stainless steel or gold, is used for the substrate in order to reduce ions to be generated from the substrate, thereby reducing noise.

However, the present invention is opposite to the conventional idea, and the substrate 3 employs a material (substance) from which its own ions are easily generable (can be easily generated) and with respect to which the m/z of the ions generated is preknown. For example, indium (In) is known to primarily produce ions having an m/z value of 115, and easily produces ions in response to exposure to laser light. Therefore, according to this embodiment, a layer of indium is formed at the surface of the substrate 3 or the substrate 3 is formed of indium, which easily produces ions.

In the case where a layer of indium is formed at the surface of the substrate 3 or the substrate 3 is formed of indium, which easily produces ions, if a pulsed laser beam transmitted through the sample 4 hits the surface of the substrate 3 with sufficient intensity, a large amount (number) of ions is generated, so that a strong peak is produced at the preknown m/z value of 115 in the m/z-ion current spectrum. If this peak is detected, it is possible to clearly recognize the possibility that noise is mixed with other signals observed in the same spectrum.

Accordingly, by not using the spectrum at the laser pulse in formation of the integrated (or averaged) spectrum, it is possible to analyze the structure of the sample 4 with more clarity based on spectra from which evident noise is removed. Further, it is also possible to use spectra with reduced noise by excluding a spectrum in which an arbitrarily determined reference value of the current intensity of the m/z of index ions is exceeded from formation of the integrated (or averaged) spectrum.

Thus, according to the laser desorption/ionization mass spectrometry method and the laser desorption/ionization mass spectrometer 1 of this embodiment, the substrate 3 has a layer of a material from which its own ions are easily generable, such as indium, formed at its surface or is itself formed of a material from which ions are easily generable, such as indium.

In addition to indium, examples of materials from which ions are easily generable include aluminum, copper, silver, magnesium, zinc, germanium, tin, lead, lithium, sodium, potassium, rubidium, cesium, beryllium, calcium, strontium, barium, cadmium, mercury, gallium, thallium, antimony, bismuth, selenium, tellurium, and alloys containing any of these elements.

According to the laser desorption/ionization mass spectrometry method and the laser desorption/ionization mass spectrometer 1 of this embodiment, it is possible to identify and separate signals to become noise with more clarity by processing measurement data as follows. That is, the ions generated from a material from which ions are easily generable, such as indium, by its exposure to laser light are employed as index ions.

Then, the sample 4 is caused to adhere to the substrate 3 having this material at its surface, and multiple pulses are emitted onto the sample 4 on the substrate 3, thereby obtaining multiple spectra. The obtained spectra are divided into two spectrum groups: the one where the signal intensity of the index ions is higher than or equal to its reference value and one where the signal intensity of the index ions is lower than its reference value. Then, in each group, the spectra are integrated or averaged so as to clarify signals to become noise.

Example

A description is given of an example of the substrate 3 for supporting the sample 4 (sample supporting substrate) used in the above-described laser desorption/ionization mass spectrometry method and laser desorption/ionization mass spectrometer 1 according to the embodiment of the present invention. In this example, a layer of indium, from the surface of which ions are easily generable in response to exposure to laser light, is formed on a copper base into a substrate. A step-by-step description is specifically given below.

(A) A flat copper plate was employed as a base, and metallic indium was attached to the surface of the base by pressure, so that a substrate having a flat surface was formed.

(B) This indium surface of the substrate was rubbed with waterproof abrasive paper so as to have minute unevenness formed thereon. Unevenness is thus formed so that a solution of a sample to be later dropped is evenly adhered to the indium surface of the substrate.

(C) The substrate thus formed was degreased through ultrasonic cleaning in order to remove organic materials that could produce ions different from those of the sample, and was dried.

(D) A sample formed by mixing a solution of tetraalkylammonium bromides (three kinds), lithium bromide, and cesium bromide in a water and ethanol mixture with a solution of N-(4-methoxy-benzylidene)-4-butylaniline in ethanol was dropped on the indium surface of the substrate, and the volatile constituents of the sample were evaporated.

(E) The substrate with the adhering sample thus prepared was placed in a laser desorption/ionization mass spectrometer, and was exposed to pulsed laser light multiple times. The generated ions were measured, and the spectrum at each pulse was stored.

(F) Indium ions having an m/z value of 115 were employed as index ions.

Figure 2:
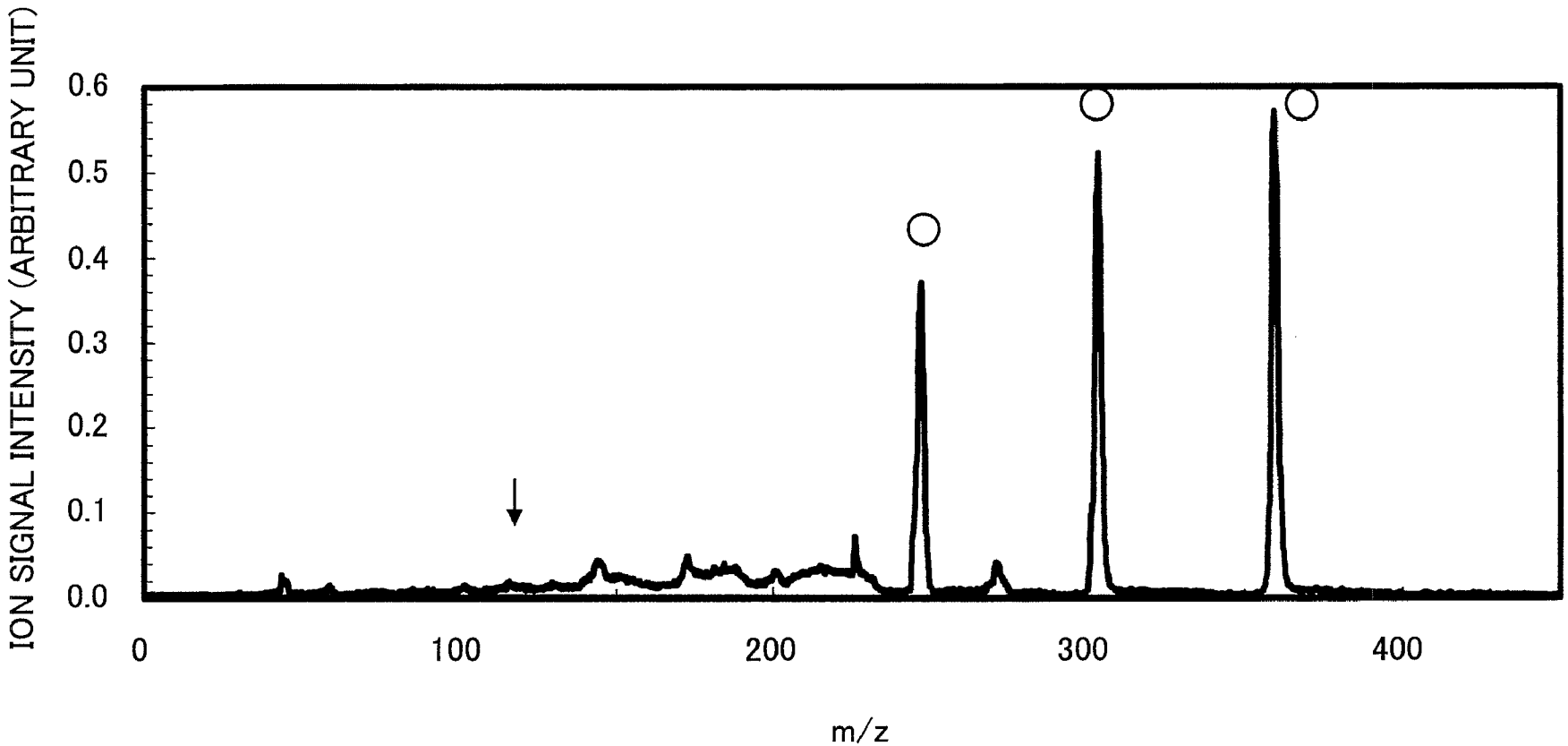
FIG. 2 is a graph showing an average spectrum of those in which the signal intensity of index ions is less than a reference value of spectra obtained by multiple exposures to laser pulses according to the embodiment of the present invention.
Figure 3:
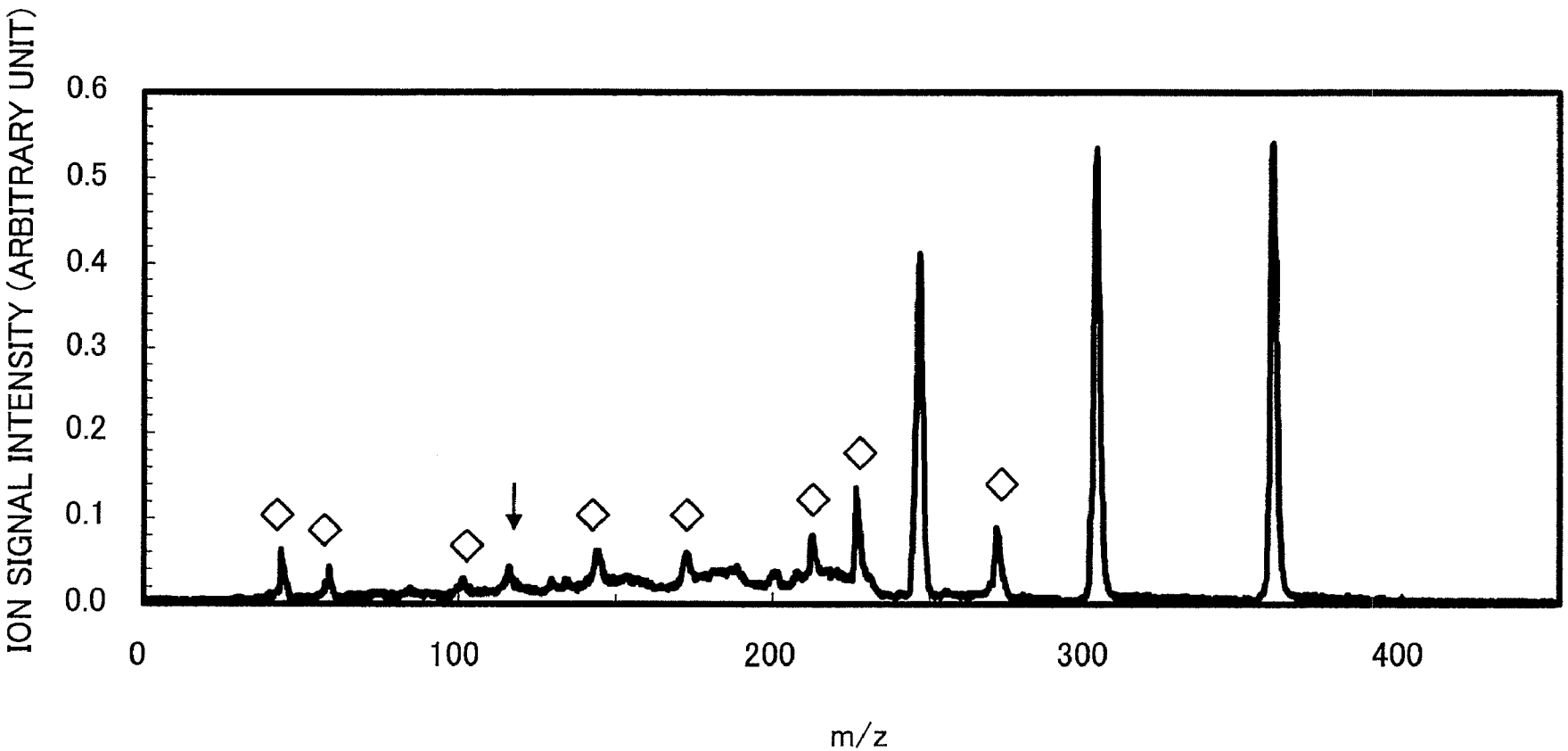
FIG. 3 is a graph showing an average spectrum of those in which the signal intensity of index ions is more than or equal to the reference value of the spectra obtained by the exposures to the laser pulses according to the embodiment of the present invention.

(G) The intensity of the signal of the index ions was determined with respect to each of the spectra obtained by the exposures to the pulses in the laser desorption/ionization mass spectrometer, and their center value was determined as a reference value. Next, the spectra corresponding to the respective laser pulses were divided into a group of those where the intensity of the signal of the index ions was less than the reference value (FIG. 2) and a group of those where the intensity of the signal of the index ions was more than or equal to the reference value (FIG. 3), and the spectra were averaged in each group. In FIG. 2, the arrow indicates the peak of the index ions, and the circles indicate the peaks of tetraalkylammonium ions. In FIG. 3, the arrow indicates the peak of the index ions, and the diamonds indicate the peaks of ions of background noise varying in signal intensity with the index ions.

(H) Comparison of the two average spectra thus obtained shows that while the average intensities of the sample-derived signals indicated by circles in FIG. 2 are substantially the same, the intensities of the signals whose peaks are indicated by diamonds in FIG. 3 vary with the signal intensity of the index ions so as to be weak or not observable at all in FIG. 2 but clearly higher in FIG. 3.

This shows that the ions of the peaks indicated by diamonds are related more strongly to the indium ions generated as a result of exposure of the substrate to laser light than to tetraalkylammonium ions, so that it can be determined that the ions of the peaks indicated by diamonds are generated from not the surface of the sample but the interface between the substrate and the sample. Accordingly, the ions indicated by diamonds can be excluded from consideration in the spectrum analysis of the sample. Further, the spectrum of FIG. 2 itself is an average spectrum from which almost all background noise is removed.

Figure 4:
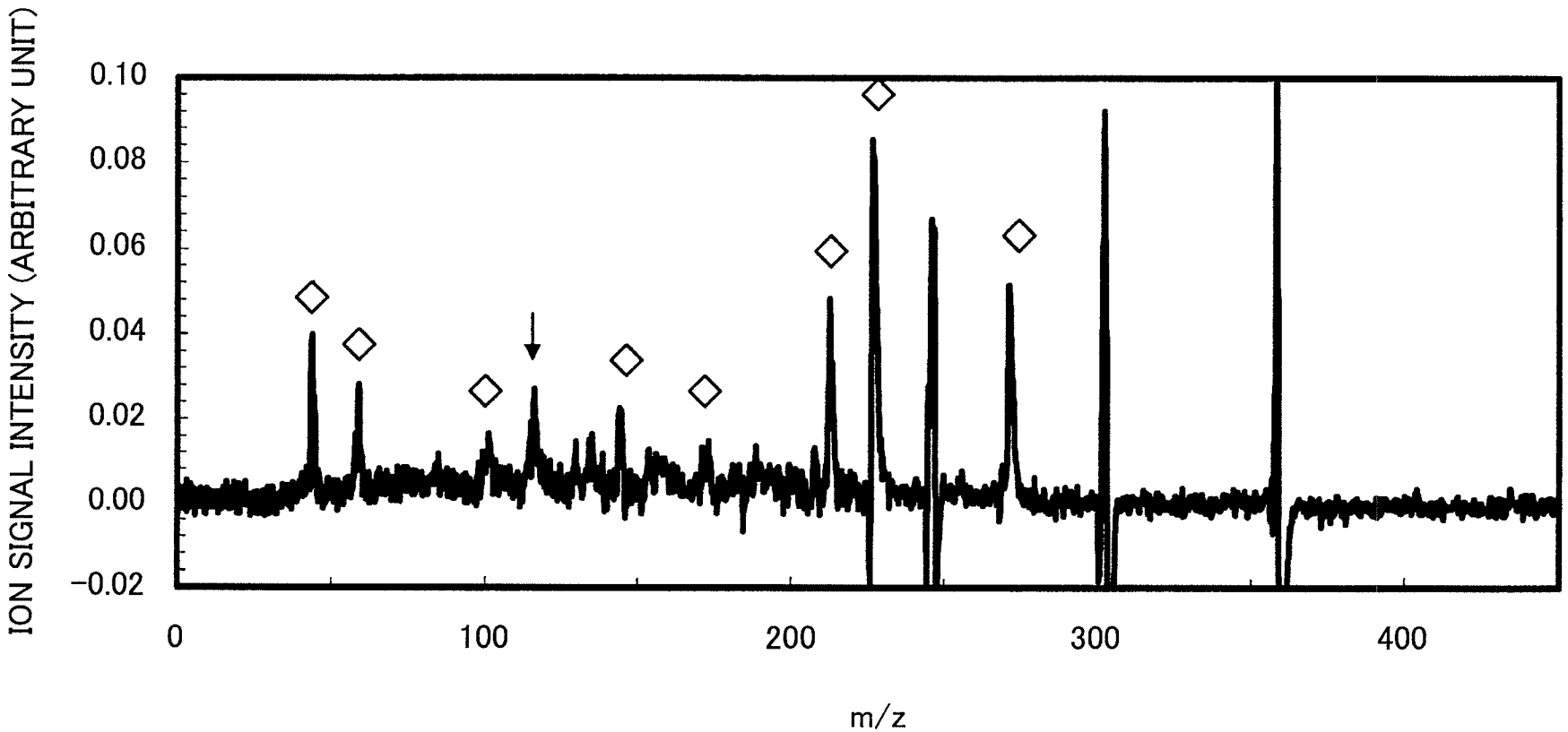
FIG. 4 is a graph obtained by subtracting the spectrum of FIG. 2 from the spectrum of FIG. 3 according to the embodiment of the present invention.

(I) By determining the difference between the two average spectra, that is, by subtracting the spectrum of FIG. 2 from the spectrum of FIG. 3, it is possible to emphasize the signal intensities of the ions indicated by diamonds as shown in FIG. 4, thus making it easier to detect noise.

Figure 5:
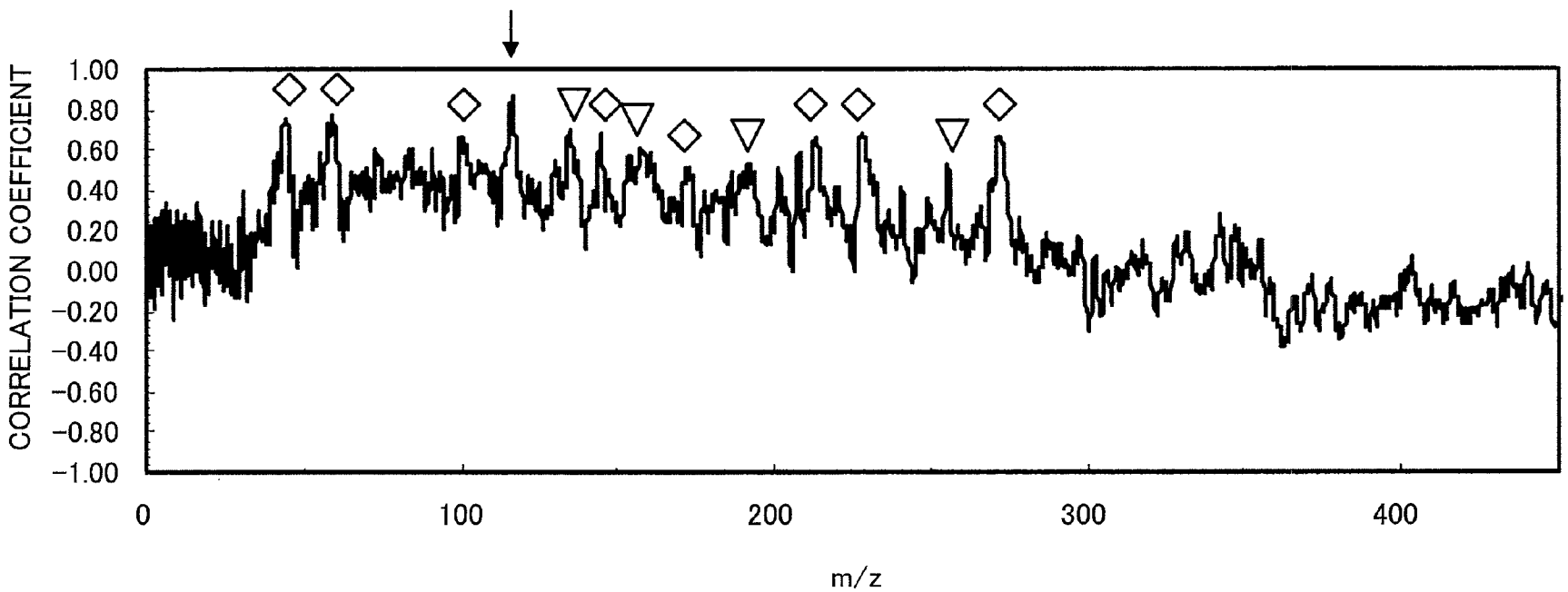
FIG. 5 is a graph showing the coefficients of correlation between the signal intensity of one m/z point in the peak of the indium ions and the signal intensities of the other m/z points of the spectrum with respect to all of the laser pulses according to the embodiment of the present invention.

(J) Further, referring to FIG. 5, which shows the coefficients of correlation between the signal intensity of one m/z point in the peak of the indium ions and the signal intensities of the other m/z points of the spectrum with respect to all of the laser pulses, almost all of the peaks of the tetraalkylammonium ions of the sample, which ions do not vary in signal intensity with the indium ions, disappear, while the peaks of the ions of noise (indicated by diamonds) appearing in FIGS. 3 and 4, which ions vary in signal intensity with the indium ions, appear again in FIG. 5 as positive correlation coefficient peaks. Further, the peaks of ions of background noise (indicated by inverted triangles) that are low (weak) in intensity so as to be indefinite in the mass spectrum of FIG. 3 can also be clearly seen in FIG. 5. In FIG. 5, a moving average operation has been performed in order to make the graph easy to visually understand. Here, the coefficients of correlation may be determined from statistical calculations or arithmetic operations.

Next, a description is given of the definition of a substrate or material from which ions are easily generable according to the embodiment of the present invention. As described above, the substrate 3 has a layer of a material from which ions are easily generable.

The substrate or material from which its own ions are easily generable according to this embodiment is determined in the following manner.

First, a test liquid is evenly applied on the surface of a (test) substrate having the same surface condition as at the time of being used for actual measurement with a ratio of 80 nl per 1 $mm^2$, and the substrate is dried.

Here, the test liquid may have the following composition.

Solvent: ethanol-water mixed solvent (ethanol water=98:2 [weight ratio]).

Solutes (concentration [per liter of the solvent]): lithium bromide and cesium bromide ($2.8\times10^{-3}$ mol/l each), and tetrabutylammonium bromide, tetrapentylammonium bromide, and tetrahexylammonium bromide ($3.9\times10^{-3}$ mol/l each).

All of the above-described five kinds of solutes are dissolved together in the solvent, and the resultant solution is employed as the test liquid.

Then, parts of the substrate surface to which the sample (test liquid) clearly adheres are exposed to pulsed laser light of the same wavelength as used for actual measurement. At this point, the laser-exposed region is moved from one part to another so that each part is exposed with different laser intensity. Further, only ions generated with the first pulse of laser are observed in each exposed part. The laser intensity is gradually varied, starting from a low level at which no ions are observed, so as to increase or decrease while observing spectra. During the observation, if preknown ions of the material (substance) of the substrate are observed whenever any univalent positive ions of the components of the sample (that is, lithium ions, cesium ions, tetrabutylammonium ions, tetrapentylammonium ions, or tetrahexylammonium ions) are observed, it is determined that the substrate (material) is one from which its own ions are generable. Here, the term "preknown ions of the material (substance) of the substrate" includes the meaning of "not being ions of an impurity contained in the substrate."

The above-described definition is based on the following experimental results.

Three kinds of substrates (stainless steel, gold, and indium) were formed and tested. (The method of forming the substrate and preparing its surface is the same as described above.) The substrates were prepared separately so as to avoid contamination with one another's material.

The surface of each substrate was rubbed with waterproof abrasive paper so as to have minute unevenness formed thereon. The substrates thus formed were degreased through ultrasonic cleaning in order to remove organic materials that could produce ions different from those of a sample, and was dried.

A test liquid prepared as described above was dropped evenly on each substrate, and the substrates were dried. Then, the substrates were set in a laser desorption/ionization mass spectrometer, and were observed following the above-described procedure.

Figure 6A:
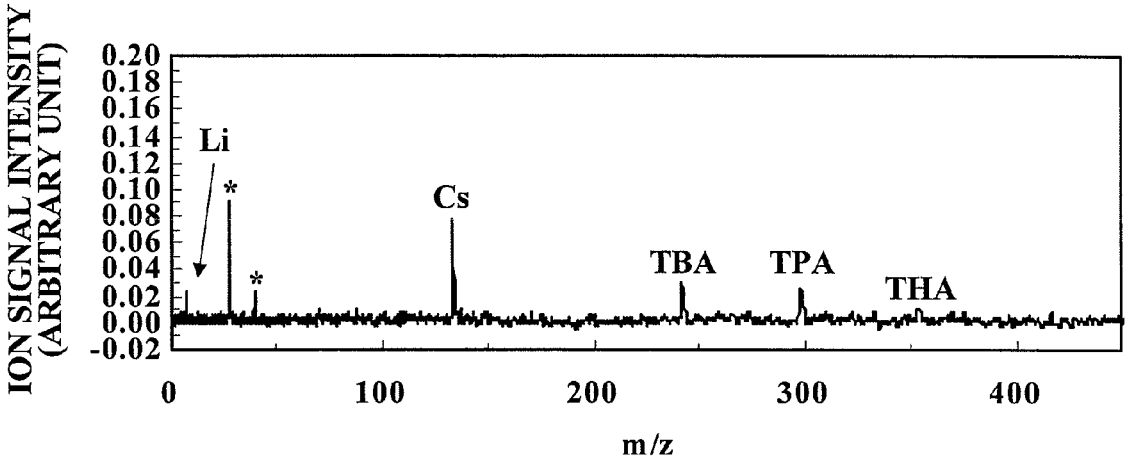
FIGS. 6A through 6C are graphs showing the results of observation of a stainless steel substrate according to the embodiment of the present invention.
Figure 6B:
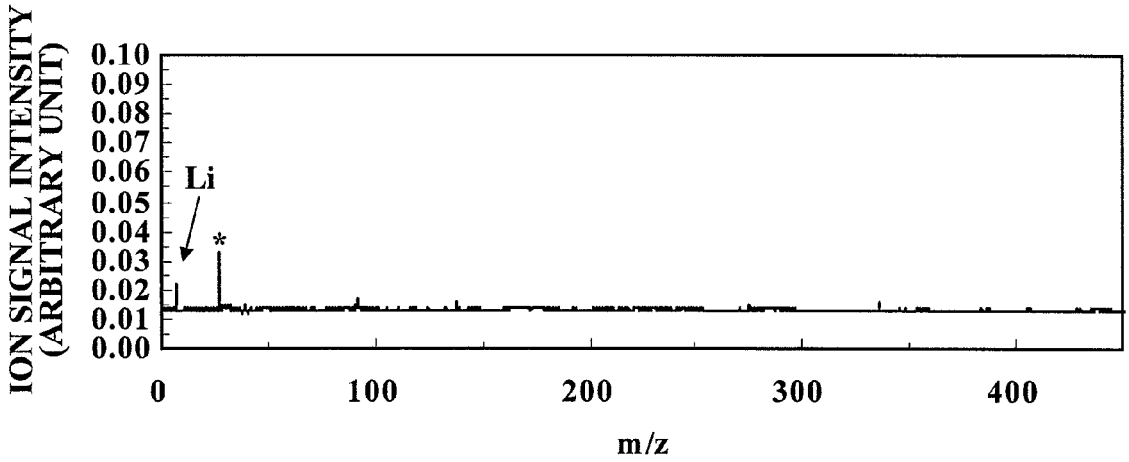
Figure 6C:
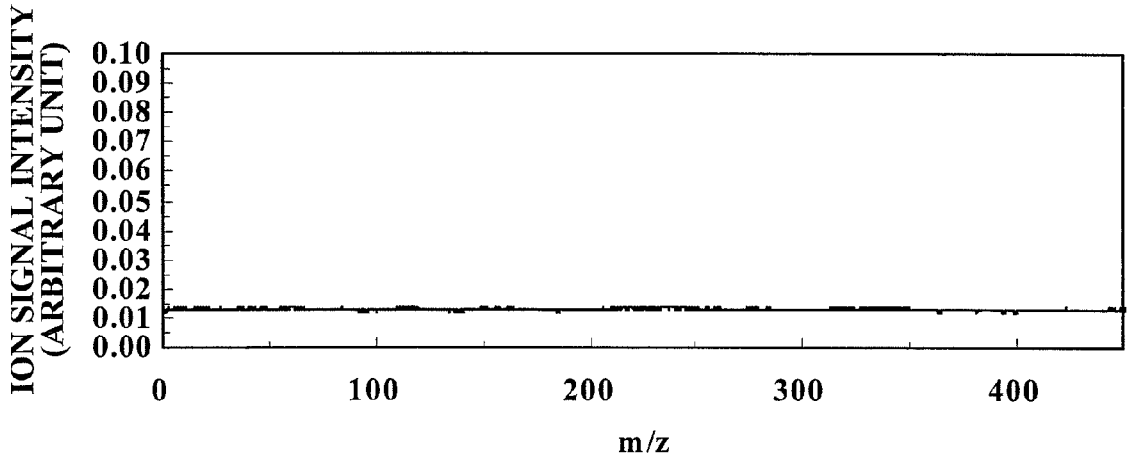

FIGS. 6A through 6C are graphs showing the results of observation of the stainless steel substrate.

The set levels (relative values) of laser intensity are 1.14, 1.00, and 0.77 in FIGS. 6A, 6B, and 6C, respectively.

Referring to FIG. 6C, no ions are observed. Referring to FIG. 6B, lithium (Li) ions are observed, but no ions of iron (m/z=56), nickel (m/z=58), or chromium (m/z=52), each being a principal component of stainless steel, are observed. Referring to FIG. 6C, cesium (Cs) ions, tetrabutylammonium (TBA) ions, tetrapentylammonium (TPA) ions, and tetrahexylammonium (THA) ions are observed in addition to the lithium ions, but no ions of iron, nickel, or chromium are observed. (In FIGS. 6A through 6C, an asterisk [*] indicates ions that are derived from one or more impurities related to neither the substrate nor the sample. The same applies hereinafter.) From the above-described observation results, in particular, from FIG. 6B, it is determined that the stainless steel substrate is not a "substrate from which its own ions are easily generable" according to the embodiment of the present invention.

Figure 7A:
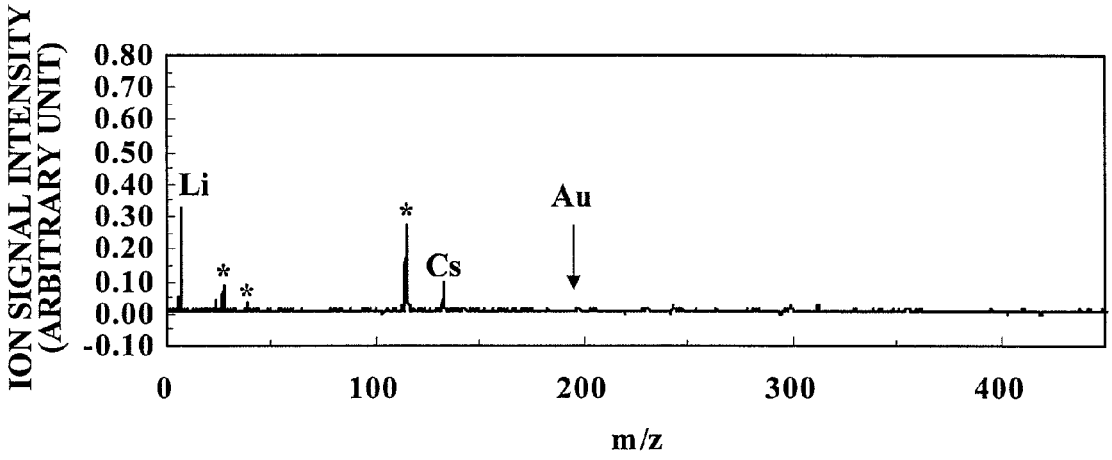
FIGS. 7A through 7C are graphs showing the results of observation of a gold substrate according to the embodiment of the present invention.
Figure 7B:
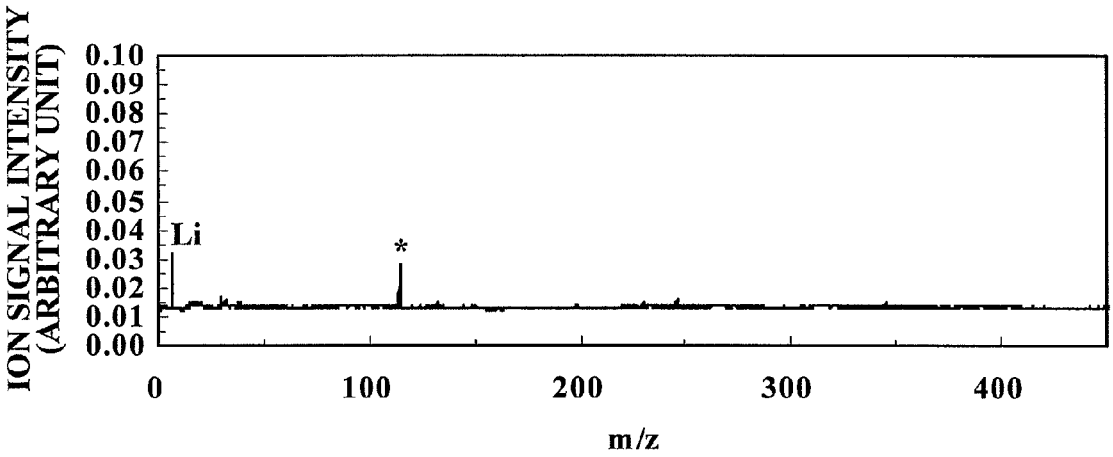
Figure 7C:
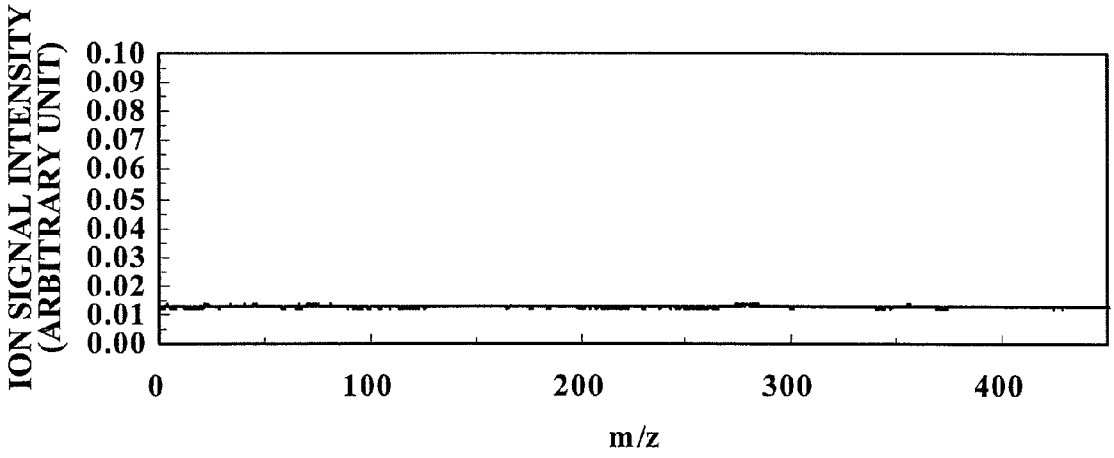

FIGS. 7A through 7C are graphs showing the results of observation of the gold substrate.

The set levels (relative values) of laser intensity are 1.14, 1.00, and 0.77 in FIGS. 7A, 7B, and 7C, respectively.

Referring to FIG. 7C, no ions are observed. Referring to FIG. 7B, lithium (Li) ions are observed, but no ions of gold, which is the component of the substrate, are observed. Referring to FIG. 7A, cesium ions are observed and gold (Au) ions, though weakly, are observed in addition to the lithium ions. From these observation results, in particular, from FIG. 7B, it is determined that the gold substrate is not a "substrate from which its own ions are easily generable" according to the embodiment of the present invention. In FIGS. 7A and 7B, ions that seem to be indium ions are observed at an m/z of 115 as indicated by an asterisk, but these ions are considered to be those of an insubstantial amount of impurity contained in the used gold.

Figure 8A:
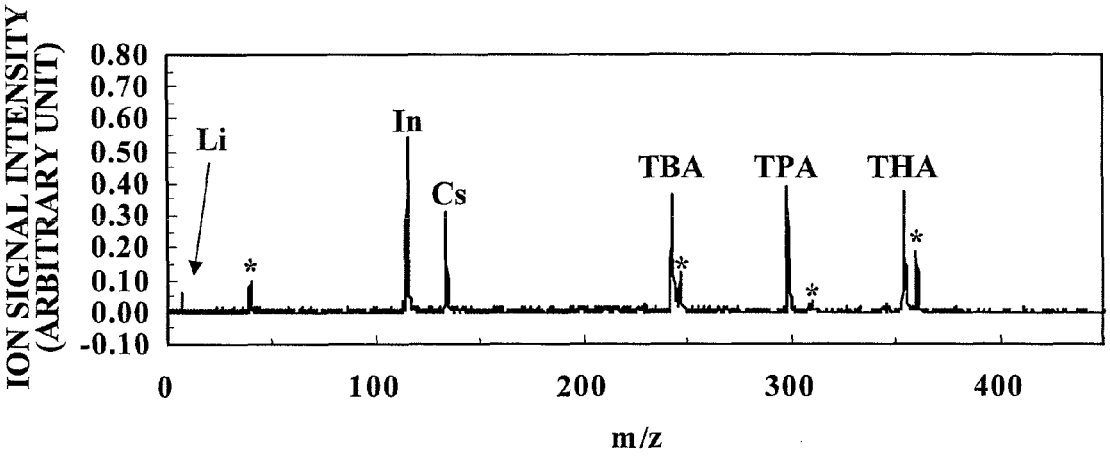
FIGS. 8A through 8C are graphs showing the results of observation of an indium substrate according to the embodiment of the present invention.
Figure 8B:
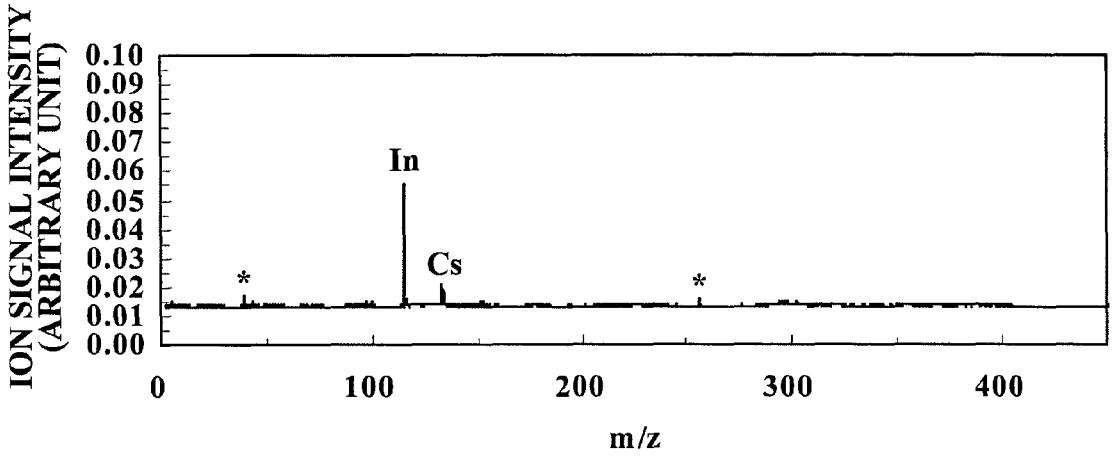
Figure 8C:
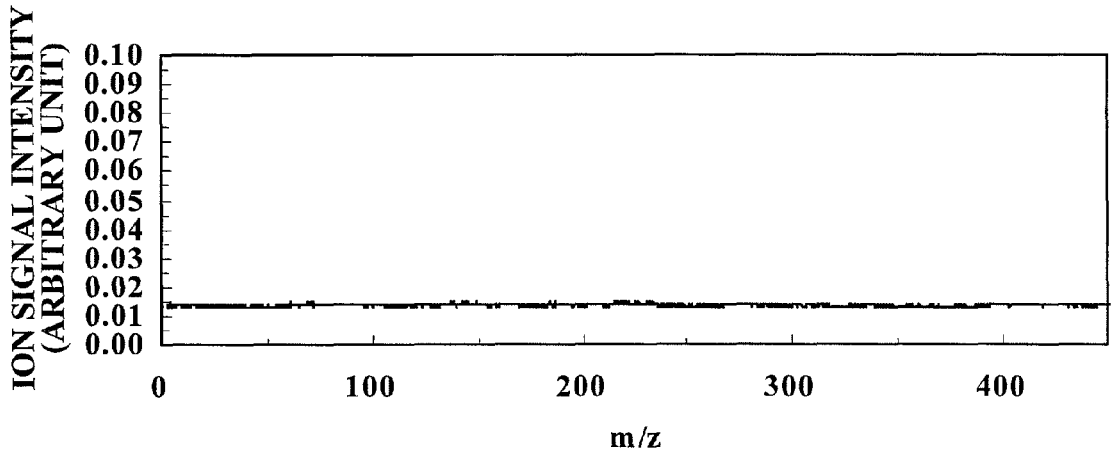

FIGS. 8A through 8C are graphs showing the results of observation of the indium substrate.

The set levels (relative values) of laser intensity are 1.14, 1.00, and 0.46 in FIGS. 8A, 8B, and 8C, respectively.

Referring to FIG. 8C, no ions are observed. Referring to FIG. 8B, ions of indium (In), which is the component of the substrate, are observed together with cesium ions of the sample. Referring to FIG. 8A, all the univalent positive ions of the sample (lithium ions, cesium ions, tetrabutylammonium ions, tetrapentylammonium ions, and tetrahexylammonium ions) are observed together with the indium ions. In other spectra (not graphically illustrated) than those of FIGS. 8A through 8C also, indium ions are observed whenever any univalent positive ions of the components of the sample are observed. Thus, it is determined that the indium substrate is a "substrate from which its own ions are easily generable" according to the embodiment of the present invention.

There seems to be more noise in FIGS. 6A, 7A, and 8A than in FIGS. 6B, 6C, 7B, 7C, 8B, and 8C. This is because the range of a measuring device is switched in accordance with the intensity of an ion signal. (In practice, a detector signal is divided into two to be input to two channels of different ranges of the measuring device so that the two divided signals are measured and recorded at the same time.) That is, the greater the range is, the higher the noise due to A/D conversion is.

Application of the present invention in analytical work in the field of environmental technology or in the field of manufacture of various products increases the amount of information to be obtained, so that it is possible to expect improvement in analytical quality and an increase in throughput.

Thus, according to a laser desorption/ionization mass spectrometry method and a sample supporting substrate used in laser desorption/ionization mass spectrometry of the present invention, it is possible to automatically or manually extract a desirable peak and/or remove undesirable background noise by determining index ions and the reference value of the signal of the index ions. Further, the amount of information to be obtained increases because of improvement in spectrum quality, so that the efficiency of analysis is improved.

The present invention is not limited to the specifically disclosed embodiment, and variations and modifications may be made without departing from the scope of the present invention.

The present application is based on Japanese Priority Patent Application No. 2007-120917, filed on May 1, 2007, the entire contents of which are hereby incorporated by reference.

What is claimed is:

1. A substrate for supporting a sample to be subjected to a spectrum analysis in a laser desorption/ionization mass spectrometer performing laser desorption/ionization mass spectrometry based on ions generated by exposing the sample supported on the substrate to laser light, the substrate comprising:

a material from which ions thereof are easily generable in response to the exposure to the laser light, the material being provided at least a surface of the substrate, so that the ions generated from the material are determined to be index ions and a signal to become noise in the laser desorption/ionization mass spectrometry is determined using a signal of the index ions, thereby performing the spectrum analysis without an effect of the noise, wherein when the substrate is exposed to the laser light with varying intensity with a solution containing a plurality of different salts as solutes being applied evenly on the substrate, the ions of the material are observed whenever univalent positive ions of the solution are observed.

2. The substrate as claimed in claim 1, wherein the salts comprise lithium bromide, cesium bromide, tetrabutylammonium bromide, tetrapentylammonium bromide, and tetrahexylammonium bromide.

3. The substrate as claimed in claim 1, wherein:

a mass-to-charge ratio of the ions generated from the material is preknown.

4. The substrate as claimed in claim 1, wherein the material of the substrate is indium.

5. A method of performing laser desorption/ionization mass spectrometry based on ions generated by exposing a sample supported on a the substrate as set forth in claim 1 to laser light, the sample being to be subjected to a spectrum analysis, the method comprising the steps of:

(a) providing the substrate of claim 1;

(b) causing a part of the ions to be generated through one of an interaction between the laser light and a surface of the substrate and an interaction between the laser light and an interface between the substrate and the sample; and (c) determining the generated part of the ions to be index ions and identifying a signal to become noise in the laser desorption/ionization mass spectrometry using a signal of the index ions, thereby performing the spectrum analysis without an effect of the noise.

6. The method as claimed in claim 5, wherein the substrate comprises metallic indium; and the index ions are derived from the metallic indium.

7. The method as claimed in claim 5, wherein said step (b) identifies the signal to become the noise by dividing a plurality of spectra obtained by exposing the sample on the substrate to a plurality of pulses of the laser light into a first group of spectra in which an intensity of the signal of the index ions is higher than or equal to a reference value and a second group of spectra in which the intensity of the signal of the index ions is lower than the reference value, and performing one of integration and averaging on the spectra in each of the first and second groups.

8. The method as claimed in claim 5, wherein a correlation between an intensity of the signal of the index ions and an intensity of another signal in a spectrum is determined based on one of statistics and an operation.

9. A method of testing a material for a substrate for supporting a sample in a laser desorption/ionization mass spectrometry, the method comprising the steps of:

preparing a test substrate of the material;

applying a solution containing a plurality of different salts as solutes evenly on the test substrate, and drying the test substrate;

exposing the test substrate to laser light with varying intensity;

observing generation of ions from the test substrate; and determining that the material is to be used for the substrate for supporting the sample in the laser desorption/ionization mass spectrometry if the ions of the material are observed whenever univalent positive ions of the solution are observed.

10. The method as claimed in claim 9, wherein the salts comprise lithium bromide, cesium bromide, tetrabutylammonium bromide, tetrapentylammonium bromide, and tetrahexylammonium bromide.

11. A substrate for supporting a sample to be subjected to a spectrum analysis in a laser desorption/ionization mass spectrometer performing laser desorption/ionization mass spectrometry, wherein:

a material of the substrate is determined by the method as set forth in claim 9.

12. A method of performing laser desorption/ionization mass spectrometry based on ions generated by exposing a sample supported on a substrate whose material is determined by the method as set forth in claim 9 to laser light, the sample being to be subjected to a spectrum analysis, the method comprising:

testing a material for a substrate as set forth in claim 9;

causing a part of the ions to be generated through one of an intersection between the laser light and a surface of the substrate and an intersection between the laser light and an interface between the substrate and the sample; and determining the generated part of the ions to be index ions and identifying a signal to become noise in the laser desorption/ionization mass spectrometry using a signal of the index ions, thereby performing the spectrum analysis without an effect of the noise.

13. The method as claimed in claim 12, wherein the substrate comprises metallic indium; and the index ions are derived from the metallic indium.

14. The method as claimed in claim 12, wherein the step of determining the generated part identifies the signal to become the noise by dividing a plurality of spectra obtained by exposing the sample on the substrate to a plurality of pulses of the laser light into a first group of spectra in which an intensity of the signal of the index ions is higher than or equal to a reference value and a second group of spectra in which the intensity of the signal of the index ions is lower than the reference value, and performing one of integration and averaging on the spectra in each of the first and second groups.

15. The method as claimed in claim 12, wherein a correlation between an intensity of the signal of the index ions and an intensity of another signal in spectrum is determined based on one of statistics and an operation.

* * * * *